United States Patent [19]

Henriques da Trindade

[11] Patent Number: 4,727,696

[45] Date of Patent: Mar. 1, 1988

[54] STABLE STRUCTURE CONSISTING OF TUBULAR COMPONENTS AND POSTTENSIONED CABLES OR OTHER TENSORY ELEMENTS

[76] Inventor: Americo A. Henriques da Trindade, Rua Jacinta Marto, 8-5o Esq., Lisbon, Portugal

[21] Appl. No.: 781,925

[22] Filed: Sep. 30, 1985

[30] Foreign Application Priority Data

Nov. 29, 1984 [PT] Portugal ..... 79575

[51] Int. Cl.[4] ..... E04C 3/10

[52] U.S. Cl. ..... 52/227; 52/86

[58] Field of Search ... 52/227, 229, 86, 245 (U.S. only)

[56] References Cited

U.S. PATENT DOCUMENTS

| | | | |
|---|---|---|---|
| 2,665,387 | 1/1954 | Bartow | 52/227 X |
| 2,892,340 | 6/1959 | Fort | 52/227 |
| 3,295,269 | 1/1967 | Schuster | 52/227 X |
| 3,559,361 | 2/1971 | Sarros | 52/227 X |
| 3,661,184 | 5/1972 | Lachenmayer | 138/89 |
| 3,791,081 | 2/1974 | Felciai | 52/227 X |
| 3,962,088 | 6/1976 | Kuhlenschmidt et al. | 52/227 X |
| 3,974,601 | 8/1976 | Steadman | 52/227 X |
| 4,284,094 | 8/1981 | Behrend | 52/86 X |
| 4,428,174 | 1/1984 | Grady, II | 52/227 X |
| 4,442,149 | 4/1984 | Bennett | 52/227 X |

FOREIGN PATENT DOCUMENTS

| | | | |
|---|---|---|---|
| 1301036 | 8/1969 | Fed. Rep. of Germany | 52/227 |
| 86340 | 5/1936 | Sweden | 52/227 |

*Primary Examiner*—Carl D. Friedman

*Attorney, Agent, or Firm*—Birch, Stewart, Kolasch, & Birch

[57] ABSTRACT

A stable structure consisting of tubular components and supporting cables or other tensory elements, where the supporting cables, used in pairs, are introduced via pairs of perforations which are positioned excentrically at the respective ends of two predefined chords of a section of the tubular component, so that the tensioning of the cables transforms what is initially an unstable structure into a completely stable one whose form is dependent upon the relative lengths of the two cables in each pair of cables.

15 Claims, 19 Drawing Figures

STABLE STRUCTURE CONSISTING OF TUBULAR COMPONENTS AND POSTTENSIONED CABLES OR OTHER TENSORY ELEMENTS

BACKGROUND OF THE INVENTION

1. Field of the Invention

The invention presented below concerns a stable structure consisting of tubular components of any shape, size or material, and post-tensioned cables or other tensory elements, and, more specifically, to a structure of this nature which may be used as a roof-covering or sheltering element in the most varied of ways and in the most varied of conditions.

More specifically, the structure constituting the basis of this invention was conceived by the purpose of covering spaces of any kind, with areas/spans of practically any dimension, in a simple, quick and economical manner, with the possibility of full recouperation of all materials involved when the said roof-covering is used on a temporary basis.

The principle upon which this invention is based is fundamentally the creation of a structure which includes, at the same time and within the same sole structure, both the covering elements themselves and the respective supporting elements, this being the opposite of all other usual roof-covers, where these two components always have to be considered separately in the application of the structure as a whole. According to the principle of this invention, it is possible to create such a structure using, as the supporting element, post-tensioned cables or other tensory elements, and, as the covering or sheltering element, tubular components of any shape, size or material, will perforations at the ends through which the supporting cables run in a perpendicular direction in relation to the longitudinal direction of the tubular components.

2. Description of the Background Art

The simplest way to achieve such a structure would be to use tubular components that were, let us say, circular, where the perforations through which the cables or other tensory elements pass were situated at the respective ends of an identical diameter of the cross-section of the tubular component. However, this solution has to be rejected, since the structure thus obtained would be unstable, which is not suitable to the objective we are aiming to achieve where complete stability is preferable and, indeed, in some cases, indispensible. In fact, the use of a single cable or other tensory element in the afore-mentioned manner, and as illustrated in FIG. 2, would yield a structure where any modification to the given form with the radius (R), would correspond to a form which would always maintain the same perimeter (P).

The use of a single cable or other tensory element passing through the tubular components via excentrically positioned perforations would also fail to yield a satisfactory result, since the post-tensioning of the cable or other tensory element would lead to the deformation of the given form in one direction only, and the structure would not be self-supporting. The use of two interacting cables or other tensory elements, which run through the tubular components via perforations positioned at either end of two chords of the cross-section of the tubular components, situated on opposite sides of an identical diameter, yields a structure where the post-tensioning of the cables or other tensory elements produces opposite effects and where, given the equilibrium between these effects, structures are obtained with completely stable and self-supporting forms, without the necessity for any kind of horizontal forces at the resting points, since all these forces are absorbed by the structure itself.

This fact is schematically illustrated in FIG. 1, which shows how the deformation of a set of two cables with the given radii ($R_1$) and ($R_2$), which correspond to the given perimeters ($P_1$) and ($P_2$), leads to transformations with the radii ($R_3$) and ($R_4$), with the perimeters ($P_3$) and ($P_4$), which are different, respectively.

An object of this invention is therefore to obtain a stable structure consisting of tubular components of any shape, size or material, and post-tensioned cables or other tensory elements, where the tubular components have, at strategic intervals along their length depending upon their resistence and strength, two pairs of perforations with adequate diameters so as to allow the passage of the supporting post-tensioned cables or other tensory elements, each pair of perforations being situated at the respective ends of a chord of the cross-section of the tubular component, where the chord corresponding to the two pairs of perforations are situated on opposite sides of an identical diameter of the cross-section of the tubular component, and where the structure in question is a stable, self-supporting structure, whose static form is determined by the relative lengths of the two post-tensioned cables or other tensory elements constituting each pair.

The tubular components should, by preference, be all the same, made from any kind of material, but which is duly appropriate to the desired function of the structure in each individual case (roof-coverings or other functions), and which, given the supporting cables or other tensory elements which run through the respective perforations and which are post-tensioned accordingly, may be joined together to obtain forms that are initially unstable, but which become completely stabilized after the post-tensioning of the cables.

The number of pairs of cables or other tensory elements, the distance between them along the respective length of the tubular components and the dimensions of the tubular components themselves will, in each individual case, depend upon conclusions drawn from a stability calculus, The tubular components need not necessarily be circular. For instance, they may be elliptic, or even non-spherical in form, so long as the given shape permits the perfect, constant and even contact of the individual elements against one another in the formation of the structure.

A roof-covering of a given desired area is obtained, in the direction in which the cables or other tensory elements are extended, via the "threading" of a given number of tubular components with a given diameter onto cables or other tensory elements of the appropriate dimension and, in the perpendicular direction, by joining together the necessary number of tubular components which are interconnecting, and by introducing the respective supporting cables or other tensory elements at each junction point.

One very important characteristic of this invention is the fact that the type of stable structures hitherto described, used either individually or appropriately joined together, can have the most varied of applications for the most varied of purposes.

Thus, for example, if, following the principle of this invention, tubular components are utilized which are all made of a given transparent material with perforations in these tubular components for the passage of the cables or other tensory elements, they can assume the form of a greenhouse used in agriculture, and which is simple, long-lasting, easy to erect and dismantle and completely recouperable.

It is equally possible to build roof-coverings and shelters for areas which must be completely protected from the rain or snow, including, for example, bus shelters. In this case, the supporting cables or other tensory elements would not run through the tubular components themselves, as this would cause impermeability problems due to the perforations. Here, it would be necessary to introduce special tubular components containing the perforations for the passage of the supporting cables or other tensory elements, which would be inserted, in a completely watertight manner, into the ends of the actual covering tubular components running between the respective rows of supporting cables and special tubular components of the structure. The functioning of this version of the roof-covering structure according to this invention is based upon the balanced tensioning of the supporting cables or other tensory elements in order to obtain the required form, which, in this case, is the one described above. It is important to point out the following advantage of roof-covering or sheltering elements conceived using the structure described herein, and which concerns the erection of same.

For instance, the erection of the structure requires no scaffolding or similar type of framework and the tubular components constituting the structure are appropriately positioned and assembled on the ground. The cables or other tensory elements are then threaded, and the erection of the structure is achieved via the tensioning of the cables. If it should prove necessary, the impermeability of the structure can be improved upon by treating the joints of the tubular components accordingly.

In a more perfected version, the tubular components used may be adapted for the captivation of solar energy, which may then be used in buildings.

A further application of the structure described herein is as a bridge, which can be erected without the slightest need for scaffolding, simply by extending the supporting cables or other tensory elements, which are threaded through the tubular components, between the two points to be connected, and then tensioning them. Using the same principle, we can also erect pedestrian walk-overs and bridges such as that shown in FIG. 8.

The structure described herein can also be used suspended in a vertical position, where special tubular components, housing the pairs of perforations, are used in constant succession, and through which the supporting cables or other tensory elements are threaded, but where the tubular components, which are connected onto the special components may or may not be alternate, depending on its application, thereby allowing, or not, for spaces between them (See FIG. 9). This version may be applied in a number of different situations where its characteristics are extremely advantageous. These are, among others:

(i) As an emergency fire-escape or ladder; the supporting cables or other tensory elements are suspended from two consoles, placed a given distance apart, and run through special tubular support elements, and the tubular components which constitute the steps are inserted alternately onto the special tubular support components at distances corresponding to the depth of one step.

(ii) As a protective covering for facades and gable-end walls of buildings under constructions. In this case, the structure is identical to the one above, but the tubular components are connected onto all of the special tubular support elements.

(iii) As a blind, where the structure is identical to the one above.

(iv) Similar structures, but on a horizontal level, may be used for covering swimming-pools when not in use, where the structure does not come into contact with the water, and allowing for free and secure passage over it.

(v) Finally, the use of structures described herein may also be considered for the construction of houses and other enclosed spaces of various shapes and sizes. (See FIG. 7).

Another important characteristic of this invention is the fact that it consists of only a small number of different types of elements, which are simple and can easily be manufactured en masse, and therefore economically.

BRIEF DESCRIPTION OF THE DRAWINGS

In order to better illustrate this invention, below is a series of descriptions of its various forms and possible applications, which are to be interpreted merely as examples which are by no means limitative, since the field of application of this structure is virtually inexhaustible, with references to drawings included in the annexes:

FIG. 7(*a*) shows a special support component utilized in the present invention in the construction of an enclosed space;

FIG. 9(*a*) shows an alternate tubular support component for use in exposed ends of tubular components;

FIG. 14(*a*) shows a flat slab structure for use in the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

The present invention will become more fully understood from the detailed description given hereinbelow and the accompanying drawings which are given by way of illustration only, and thus are not limitative to the present invention, and wherein:

Let us now look in closer detail at each of the drawings.

Figure 1:
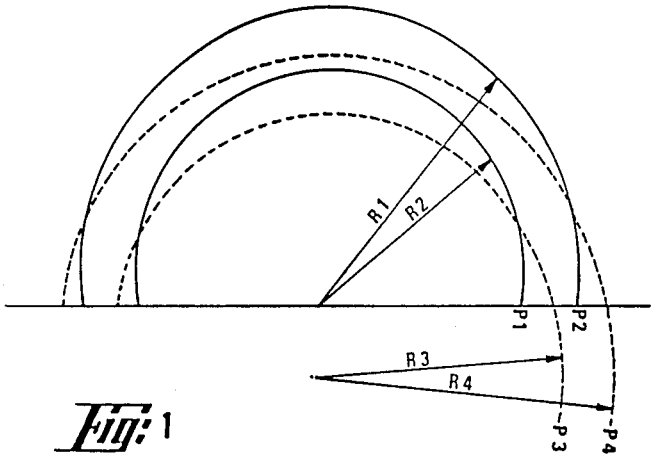
FIG. 1 and FIG. 2 show diagrams illustrating the principle upon which this invention is based.
Figure 2:
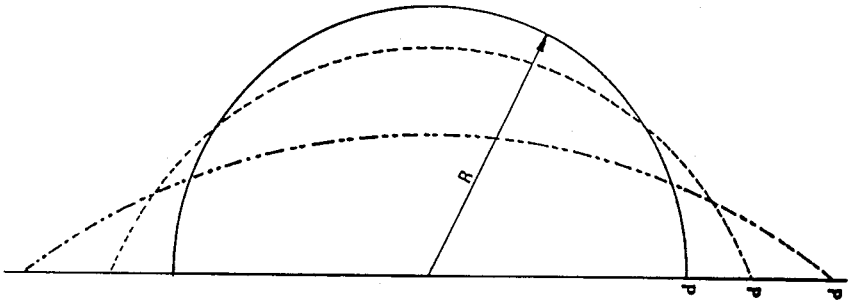
Figure 3:
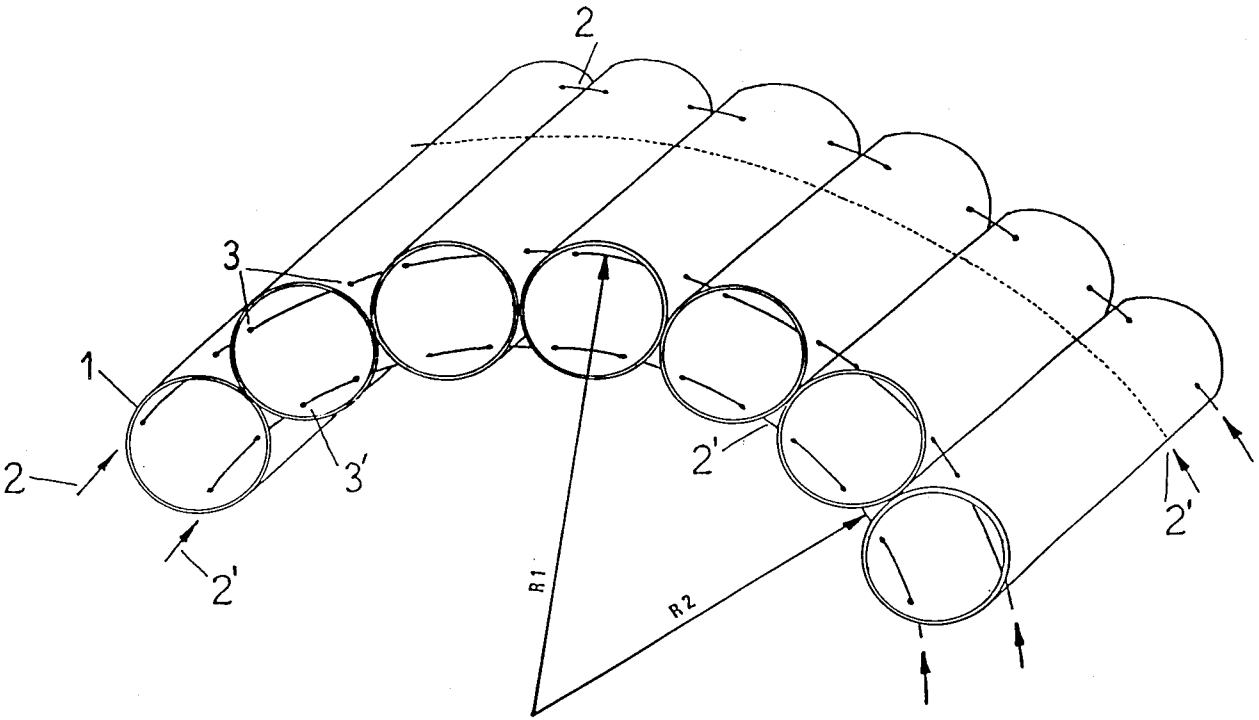
FIG. 3 illustrates schematically a structure according to this invention used in the construction of a greenhouse.

FIG. 3 is a structure according to the present invention used for the covering of a cultivated area or for a greenhouse, consisting of tubular components 1, with pairs of perforations 3, 3', through which run the supporting cables or other tensory elements 2, 2'. As indicated by the arrows, these cables are tensioned and, according to the degree of tension applied to each of the cables 2 and 2', they take on the forms with radii $R_1$ and $R_2$ respectively, from which we obtain a determined stable form of the structure. The tubular components 1 are, in this particular case, transparent.

Figures 4, 4A, 4B:
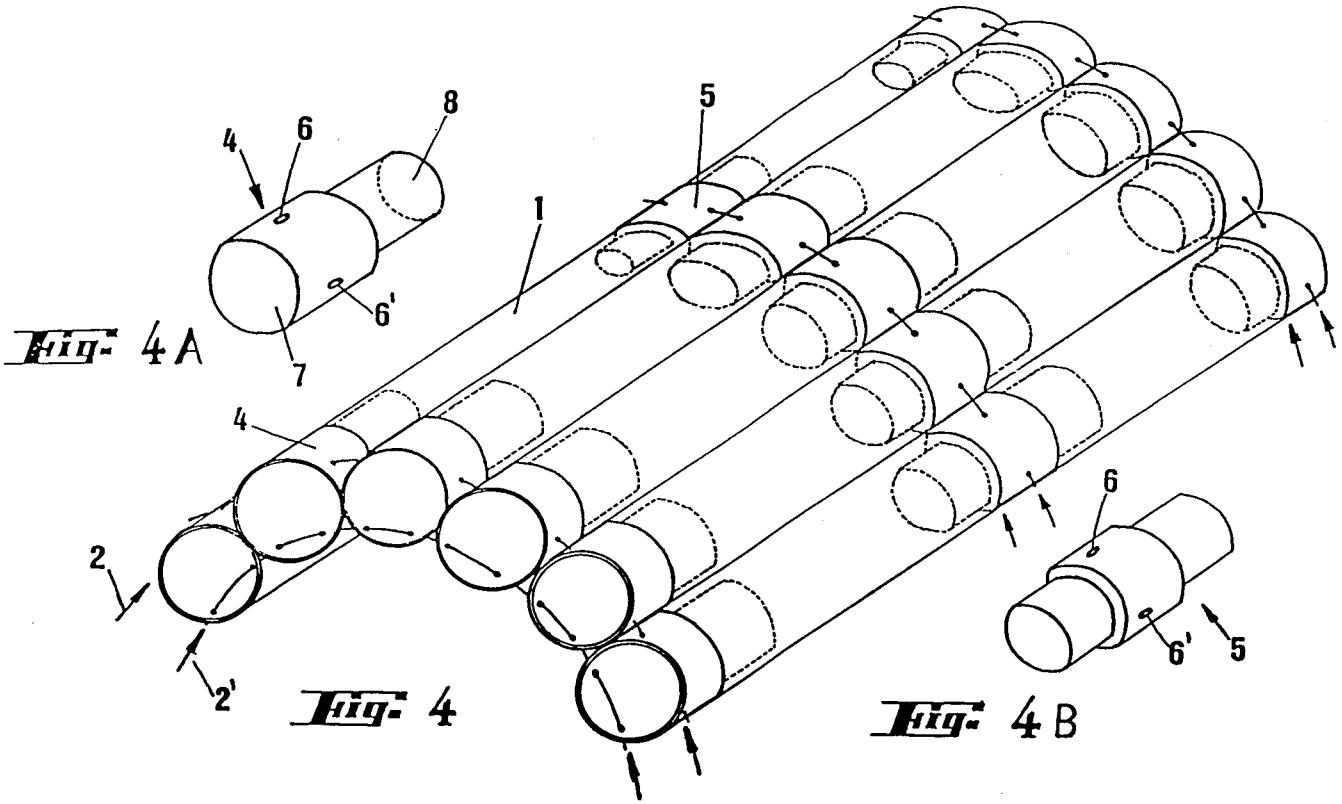
FIG. 4 shows a structure according to this invention used in the construction of a roof-covering or shelter where absolute impermeability is of the essence.
FIG. 4*a* shows the structure of a special tubular support component utilized in the present invention.
FIG. 4*b* shows a special intermediary tubular support component utilized in the present invention.

FIGS. 4–4B, the covering structure is to be an impermeable one, and therefore the tubular components 1 must not be perforated. The supporting cables or other tensory elements 2, 2' are therefore introduced via special tubular support components which may be either terminal 4 or intermediary 5, and which, in this case, contain the pairs of perforations 6 and 6'. The covering tubular components 1, which contain no perforations, are connected onto the said special support components 4 and 5, and are supported by these components.

The special terminal tubular support component 4 is a cylindrical unit with an outer terminal end section 7 that has a larger diameter than the tubular component, this being the section housing the pairs of perforations 6, 6' for the passage of the cables or other tensory elements 2, 2', its inner diameter being equal to that of the outer surface of the tubular components 1, and an inner section 8, which has a narrower diameter than the tubular component 1, and which slots into the tubular components 1, its outer diameter being approximately the same as that of the inner surface of these components 1.

Figure 5:
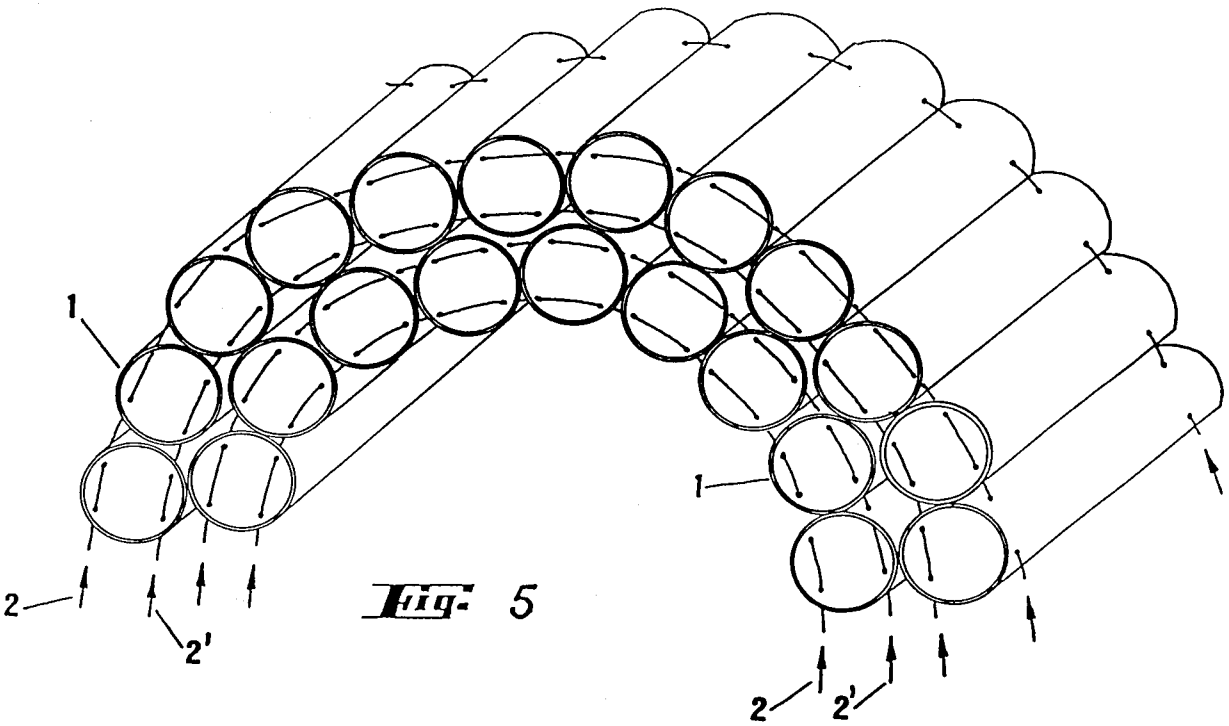
FIG. 5 shows a two-fold structure according to this invention which may be used for the covering of very large areas.

FIG. 5 shows the application of a structure according to this invention for the covering of large areas/wide spans, which may require the use of two three, four, five etc. -fold structures as is represented in the drawing.

Figure 6:
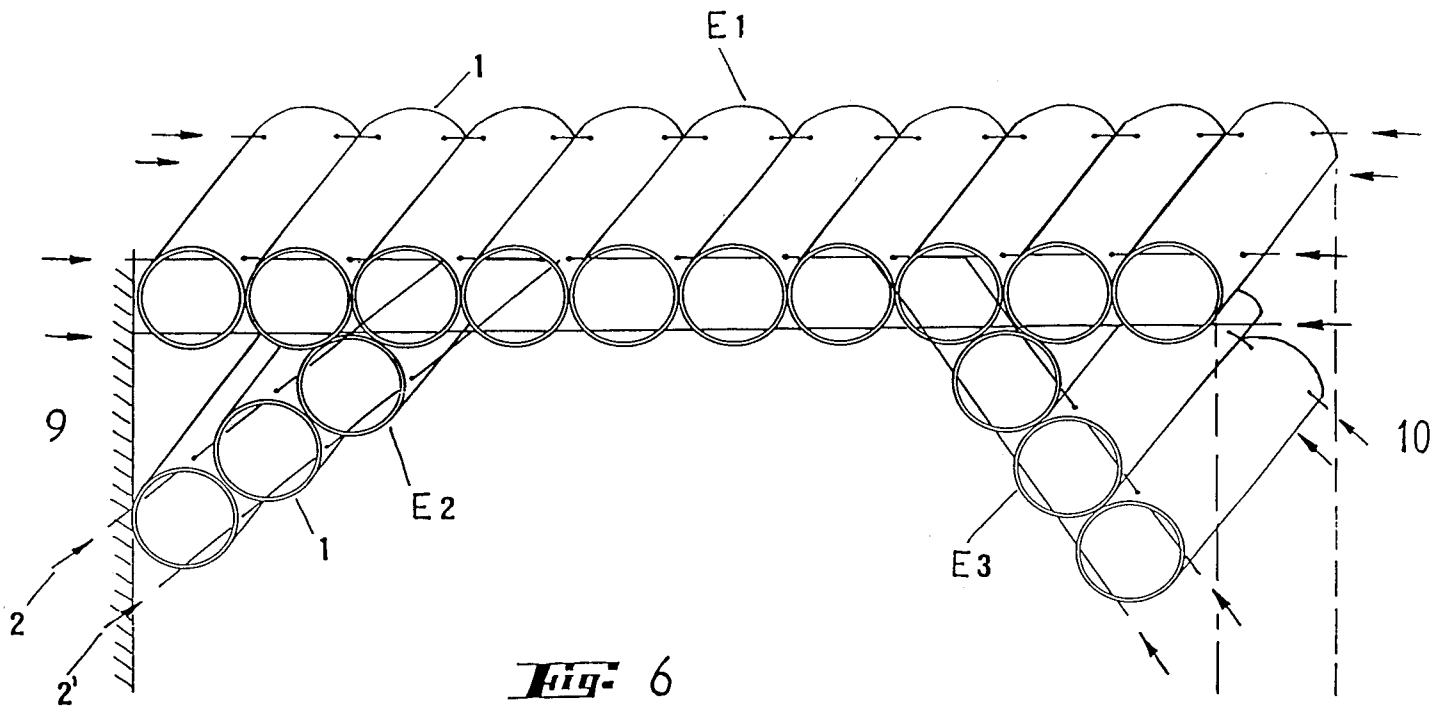
FIG. 6 shows a combination of structures according to this invention used for the construction of a bridge.

FIG. 6 shows the application of the structure according to this invention to the construction of a special bridge between two given points 9 and 10. The flat bridge portion is shown as $E_1$, and two angularly oriented stablization portions $E_2$ and $E_3$ are connected to the underside of flat portion $E_1$ and descend toward two anchor points (not shown).

Figures 7, 7A:
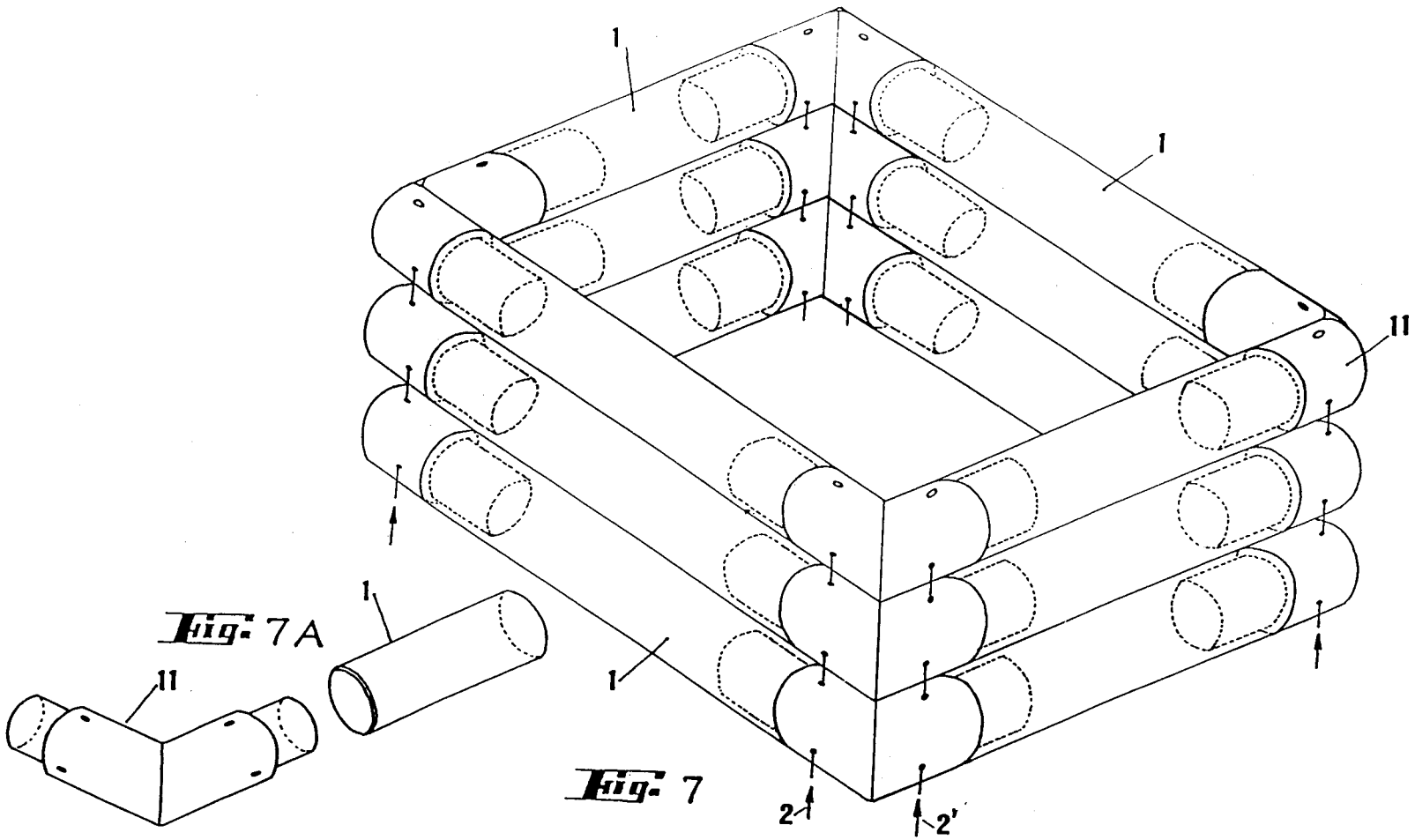
FIG. 7 shows a combination of structures according to this invention used for the construction of an enclosed space.

FIG. 7 illustrates schematically a combination of structures according to this invention for the construction of an enclosed space. The walls are composed of the tubular components 1 of the structures, which are connected onto the special support components 11, which are similar in shape and composition to the support components 4 shown in FIG. 4.

Figure 8:
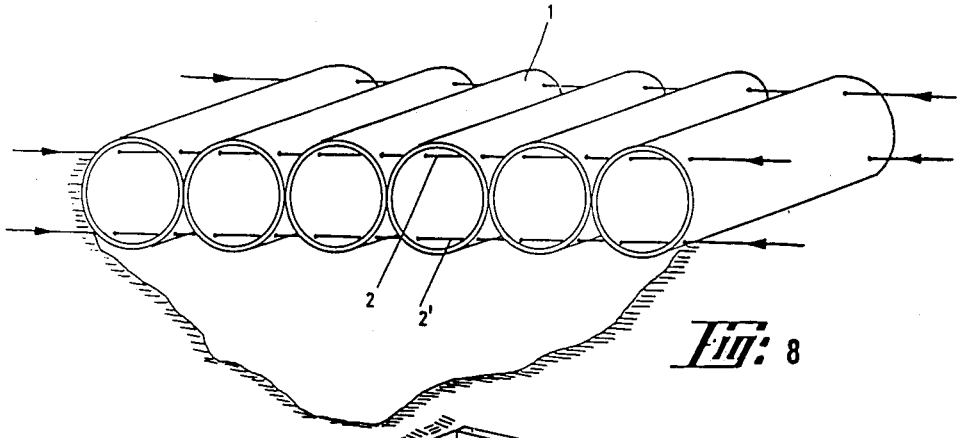
FIG. 8 shows a structure according to this invention used for the construction of a walkway or simple bridge between two given points.

FIG. 8 illustrates the application of a structure according to this invention for the construction of a walkway or simple bridge between two given points. This structure is extremely simple. It is assembled on the ground on one of the two sides to be connected, and the cables or other tensory elements are temporarily anchored on this side. Then the structure is placed in position between this and the other side to be connected by pulling the cables over to the other side, and lastly, the cables or other tensory elements are tensioned and fixed in place.

Figure 9:
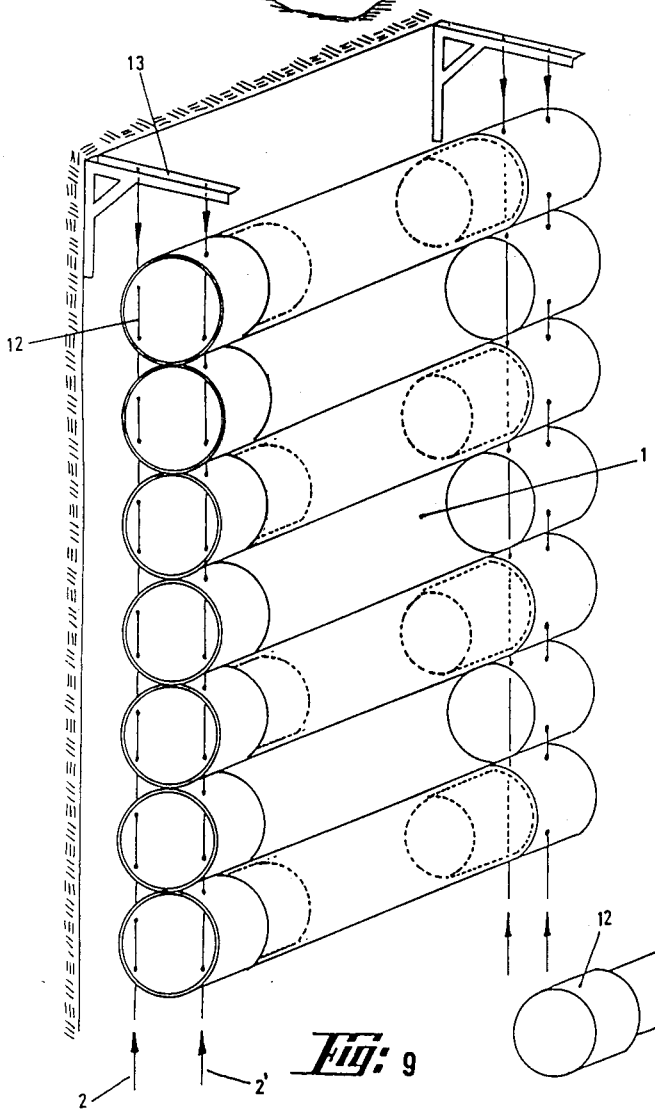
FIG. 9 shows a suspended stairway built using a structure according to this invention.
Figure 9A:
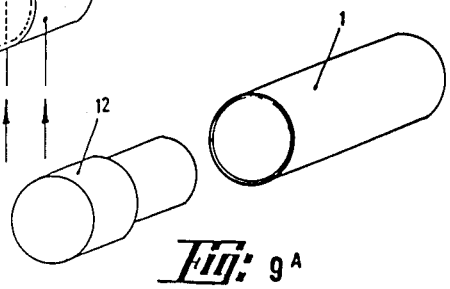

FIG. 9 represents a structure according to this invention which incorporates tubular support components 12, similar to the terminal tubular components 4 illustrated in FIG. 4, which are suspended from a console 13. In this version, the structure may be used as a vertical escape ladder, where the steps/rungs are the tubular components 1 connected onto alternate support components 12, to allow for space between steps, or as a type of blind or protective cover for facades and exposed gable-end walls of buildings during works on, or adjacent to these, for example. In this case, the tubular components 1 are connected onto all the support components 12.

Figure 10:
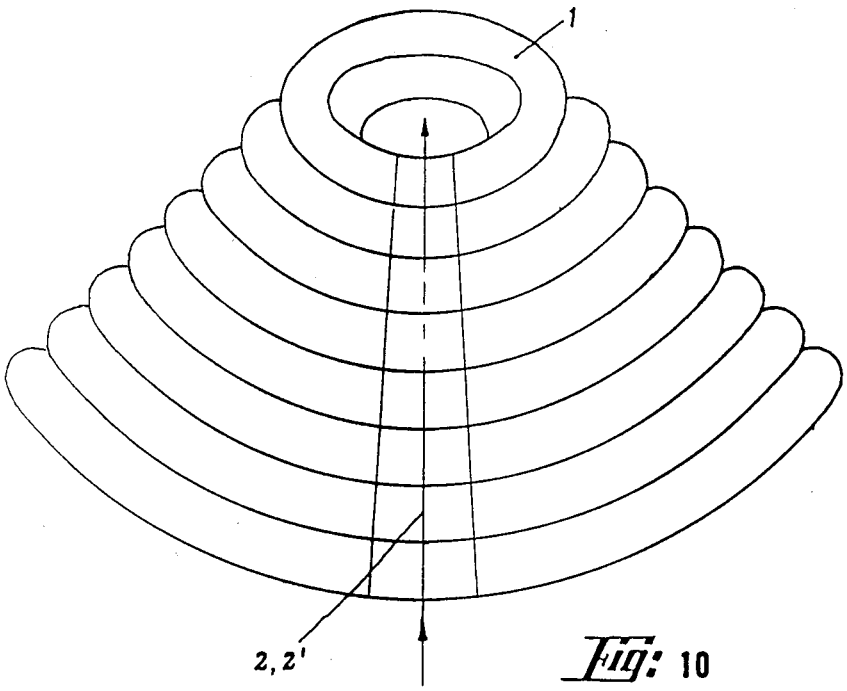
FIG. 10 and FIG. 11 are examples of other types of constructions according to the present invention, where the tubular components have, for example, a circular form.
Figure 11:
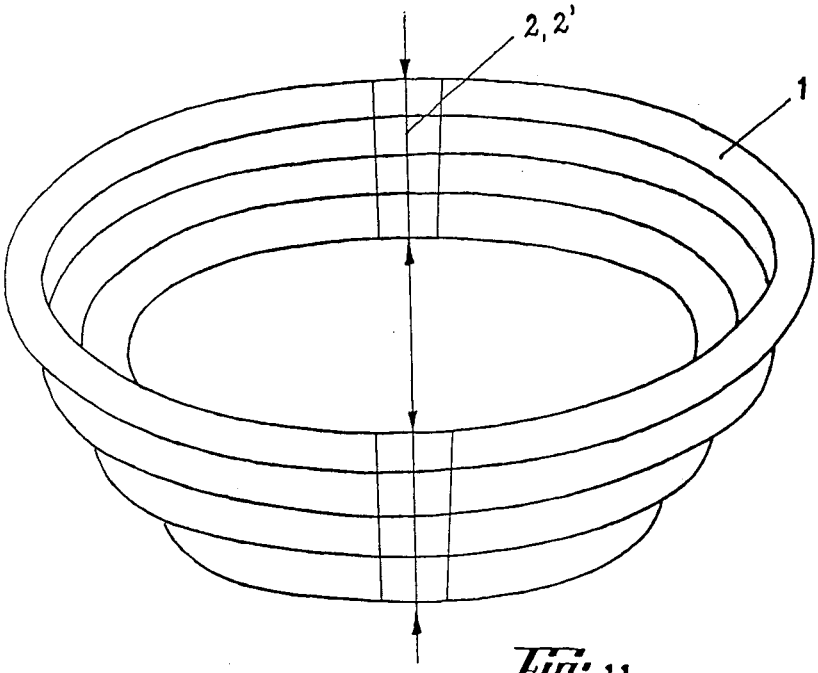

In FIG. 10 and FIG. 11, the tubular components 1 are, for example, circular and, stabilized using post-tensioned cables or other tensory elements, and supported according to the principle of this invention, they permit the construction of enclosed areas of various shapes and with a vast number of different applications.

Figure 12:
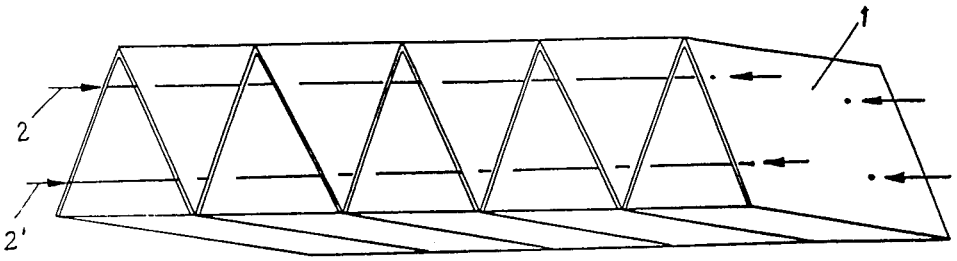
FIG. 12 shows a structure according to this invention where the tubular components have a triangular cross-section.

FIG. 12 schematically illustrates a structure according to this invention where the tubular components 1 have a triangular section, and where, as is obvious, the structure can be given either a rectilinear or a curved directional axis.

Figure 13:
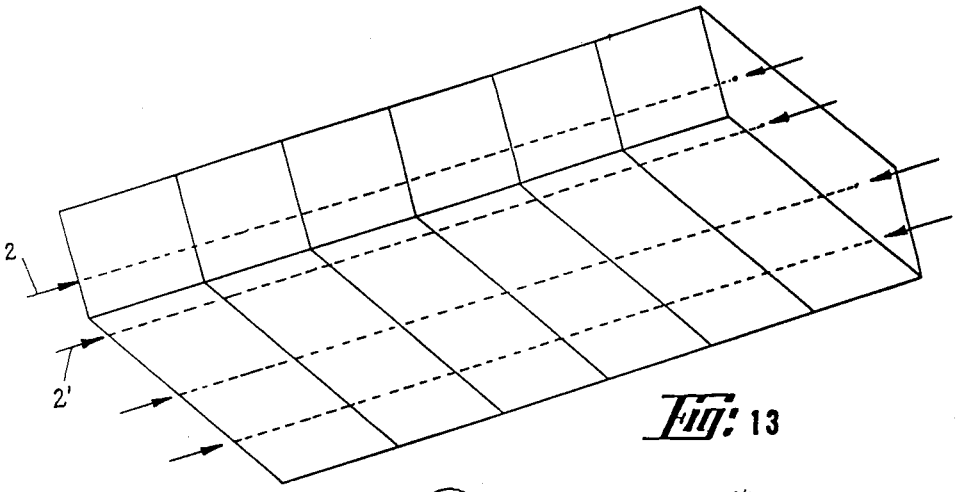
FIG. 13 shows a structure according to this invention where the tubular components are of a rectangular cross-section.

FIG. 13 shows an example of a structure according to this invention where the tubular components have a rectangular section.

Figure 14:
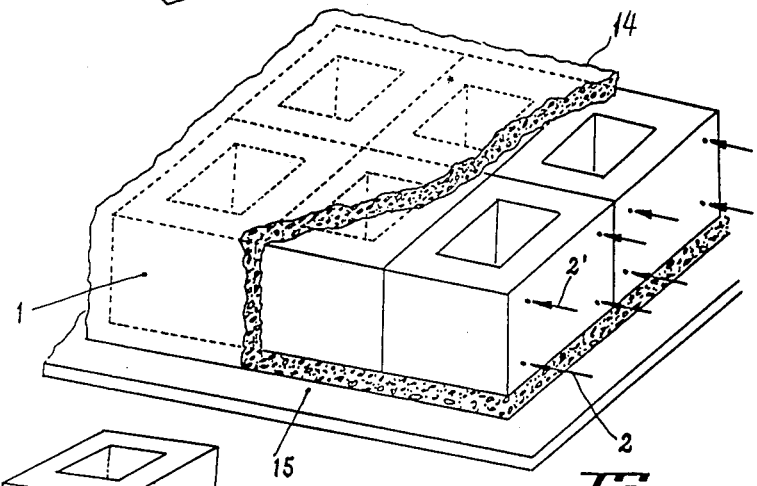
FIG. 14 shows a structure according to this invention used for the construction of flat concrete slabs, with no girders or beams, supported by the cables or other tensory elements inherent to the structure.
Figure 14A:
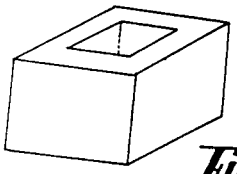

FIG. 14 represents the specific application of a structure of the type illustrated here, where the tubular components are covered with concrete 14 and are used in the construction of a flat slab with no girders or beams, and where the supporting elements are the post-tensioned supporting cables 2, 2' of the structure described according to this invention. This flat slab structure is first assembled as an encasement with a horizontal form, and the concrete is then poured over it.

Simply to exemplify a little further, below is a list of possible applications of structures according to this invention:

(i) As a roof-covering or shelter for wide spans or large areas of various dimensions in two directions (playing-fields, swimming pools, stadiums, exhibition centres, esplanades, service stations, protective covers for building sites during excavation works, protective covers for areas where demolition or implosion works are being carried out etc.)

(ii) As a vertical protective element for facades and gable-ends of buildings etc.
(iii) As pedestrian walk-overs, walk-ways, bridges etc.
(iv) As a supporting encasement for reinforced concrete slabs.
(v) As a vertical stairway or ladder.
(vi) As a false ceiling or roof.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A stable support structure comprising:

a plurality of adjacent conformable tubular components, each of said tubular components having at least two pairs of perforations formed in the periphery thereof at predetermined intervals longitudinally of and according to the length of said tubular components;

the perforations of one of said at least two pairs being located at respective ends of a first chord defined by a specified cross section of one of said tubular components, wherein said first chord diametrically opposes a second similar chord defined by the perforations of the other of said at least two pairs in another specified cross section of the same tubular component; and tensory means, threaded through said pairs of perforations of adjacent tubular components, for forming said stable support structure whose static form is determined by the relative lengths of said tensory means and by the relative lengths of the diametrically opposed chords.

2. A stable support structure according to claim 1, wherein said plurality of tubular components are identical and may be manufactured en masse, said tubular components further being made of any material which is duly appropriate to the desired function of the structure in each individual case.

3. A stable support structure according to claim 2, wherein said plurality of tubular components are made of a transparent material.

4. A stable support structure according to claim 3, wherein a plurality of similar tubular sections are assembled in parallel for covering spaces with areas of any dimension, said plurality of similar tubular sections assembled in parallel being in a direction perpendicular to said tensory means, wherein said adjoining tubular sections are interconnected with special junction components.

5. A stable support structure according to claim 2, wherein a plurality of similar tubular sections are assembled in parallel for covering spaces with areas of any dimension, said plurality of similar tubular sections assembled in parallel being in a direction perpendicular to said tensory means, wherein said adjoining tubular sections are interconnected with special junction components.

6. A stable support structure according to claim 2, wherein said plurality of tubular components are adapted for the captivation of solar energy.

7. A stable support structure according to claim 6, wherein a plurality of similar tubular sections are assembled in parallel for covering spaces with areas of any dimension, said plurality of similar tubular sections assembled in parallel being in a direction perpendicular to said tensory means, wherein said adjoining tubular sections are interconnected with special junction components.

8. A stable support structure according to claim 1, wherein said plurality of tubular components have a cross-section which may be circular, elliptic or of any non-spherical form, but which permits the perfect, constant and even contact between threaded adjoining tubular components of the structure.

9. A stable support structure according to claim 8, wherein a plurality of similar tubular sections are assembled in parallel for covering spaces with areas of any dimension, said plurality of similar tubular sections assembled in parallel being in a direction perpendicular to said tensory means, wherein said adjoining tubular sections are interconnected with special junction components.

10. A stable support structure according to claim 1, wherein a plurality of similar tubular sections are assembled in parallel in sufficient quantities to cover spaces with areas of any dimension in a direction perpendicular to said tensory means, wherein said adjoining tubular sections are interconnected with special junction components.

11. A stable support structure according to claim 1, wherein said structure is used as a roof-covering or shelter, and wherein said plurality of tubular elements constitute the covering element, and wherein said tensory means is the supporting element of the structure.

12. A stable support structure according to claim 1, with different forms which are appropriate to diverse applications including bridges, pedestrian walkways, enclosed areas, protective coverings for facades and gable-end walls of buildings under construction, vertical emergency stairways and ladders, covers for swimming-pools, supporting encasements for reinforced concrete slabs and all other possible similar applications.

13. A stable support structure according to claim 1, wherein said tensory means are post-tensioned supporting cables.

14. A stable support structure comprising:

a plurality of adjacent conformable tubular components;

a plurality of inner sections insertable within said tubular components to prevent water from entering or passing through said tubular components and allowing for the construction of a completely watertight support structure;

a plurality of tubular support components surrounding the outer periphery of selected portions of said plurality of tubular components, each of said tubular support components having at least two pairs of perforations formed in the periphery thereof;

the perforations of one of said at least two pairs being located at respective ends of a first chord defined by a specified cross section of one of said tubular support components, wherein said first chord diametrically opposes a second similar chord defined by the perforations of the other of said at least two pairs in another specified cross section of the same tubular support component; and tensory means, threaded through said pairs of perforations of adjacent tubular components, for forming a stable support structure whose static form is determined by the relative lengths of said tensory means and by the relative lengths of said diametrically opposed chords.

15. A stable support structure according to claim 14, wherein a plurality of similar tubular sections are assembled in parallel for covering spaces with areas of any dimension, said plurality of similar tubular sections assembled in parallel being in a direction perpendicular to said tensory means, wherein said adjoining tubular sections are interconnected with special junction components.

* * * * *